US006302168B1

(12) United States Patent
Hu

(10) Patent No.: US 6,302,168 B1
(45) Date of Patent: Oct. 16, 2001

(54) AUTOMATED PRECISION LIQUID METERING APPARATUS USING INJECTORS AS METERING DEVICES

(76) Inventor: Hugo Hu, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/612,460

(22) Filed: Jul. 7, 2000

(51) Int. Cl.[7] ..... B67C 3/00

(52) U.S. Cl. ..... 141/130; 141/74; 141/83; 141/104; 141/232; 141/263

(58) Field of Search ..... 141/72, 74, 80, 141/83, 100, 102, 104, 105, 130, 232, 263, 275, 281, 282, 283, 284

(56) References Cited

U.S. PATENT DOCUMENTS 3,607,094 * 9/1971 Beer ..... 422/63
3,767,364 * 10/1973 Ritchie et al. ..... 422/50
4,166,094 * 8/1979 Froehlich et al. ..... 73/864.25
4,347,750 * 9/1982 Tersteeg et al. ..... 73/864.31
4,856,563 * 8/1989 Yamaguchi et al. ..... 141/1
5,626,740 * 5/1997 Seto et al. ..... 205/789

* cited by examiner

*Primary Examiner*—J. Casimer Jacyna
*Assistant Examiner*—Peter DeVore

(57) ABSTRACT

An automated precision liquid metering apparatus using injectors as metering devices is provided. The apparatus mainly includes a plurality of storage containers uniformly spaced on a plane in multiple rows. Each storage container is sealed with a cap and has a loadstone disposed therein. A stirring means is located below the storage containers to cause the loadstones rotate and thereby evenly stir liquid in the storage containers. The cap of each storage container has at least one injector extended therethrough. A liquid sucking-releasing means mounted on a traveling means could be shifted to locate above a selected storage container under control of a control means. When the liquid sucking-releasing means is descended, it grabs the injector on the selected storage container, and when the same means is ascended, it causes the injector to suck in an amount of liquid from the selected storage container while extracting the same injector from the selected storage container. The extracted injector is then moved by the traveling means to a receptacle positioned on an electronic balance and caused by said liquid sucking-releasing means to release all the previously sucked liquid into the receptacle at where the liquid is precisely measured with the electronic balance.

4 Claims, 6 Drawing Sheets

AUTOMATED PRECISION LIQUID METERING APPARATUS USING INJECTORS AS METERING DEVICES

BACKGROUND OF THE INVENTION

1. Field of the Invention

The present invention relates to an automated precision liquid metering apparatus, and more particularly to an automated precision liquid metering apparatus which includes a plurality of injectors that are used as metering devices and can be controlled through a microcomputer and a control circuit to suck a fixed amount of specified liquid from a storage container and then be shifted to release the sucked liquid into a receptacle on an electronic balance at where the specified liquid is precisely measured.

2. Description of the Prior Art

Most of the currently commercially available automatic liquid metering apparatuses use metering valves to precisely control the amount of a specified liquid allowed to flow from a storage container to a receptacle. FIG. 1 illustrates a most commonly adopted automatic liquid metering apparatus in which a plurality of storage containers 10 are included, a conveyance tube 11 is provided to extend between each storage container 10 and a receptacle 16 positioned on an electronic balance 15, and a metering valve 12 is connected to the conveyance tube 11 at a point close to the storage container 10. To use the above-described liquid metering apparatus to supply a precisely metered amount of a specified chemical liquid, a signal for opening the metering valve 12 that controls the flow of the specified liquid is sent by a control circuit 14 via a microcomputer 13 to the metering valve 12. Under the siphonic action, the specified liquid flows from the storage container 10 via the conveyance tube 11 into the receptacle 16 on the electronic balance 15. A signal representing a measured weight of the specified liquid in the receptacle 16 is then sent by the electronic balance 15 to the microcomputer 13 and the control circuit 14. When the specified liquid reaches a predetermined amount, the microcomputer 13 and the control circuit 14 sends a signal to close the metering valve 12 and thereby stop the supply of the specified liquid from the storage container 10. In a practical application of the above-described automatic precision liquid metering apparatus, as shown in FIG. 2, there are usually several decades or even several hundreds of storage containers 10, conveyance tubes 11 and metering valves 12 included in the apparatus for the same to work economically and practically.

The following are some disadvantages of the above-described conventional precision liquid metering apparatus of FIG. 2:

1. Each of the storage containers 10 must be equipped with one metering valve 12 to meter the amount of liquid flown out from the storage container 10, and each metering valve 12 requires complicate wiring for forming its control circuit. The manufacturing cost of the whole precision liquid metering apparatus of FIG. 2 is therefore very high.

2. In the event the metering valve 12 each includes a one-stage ON/OFF opening, such opening must be small for the metering valve 12 to precisely meter the liquid flowing therethrough. In this case, the flow rate of the liquid from the storage container 10 to the receptacle 16 is inevitably low and results in an extended time required to complete the supply of the specified liquid.

3. On the contrary, in the event the metering valve 12 each includes a multi-stage opening, although the specified liquid can be quickly supplied and precisely metered, the metering valve 12 would have more complicate structure and the apparatus of FIG. 2 would therefore require higher manufacturing cost.

4. Each storage container 10 requires one conveyance tube 11 that also forms a considerable cost of the whole apparatus of FIG. 2. And, it takes time for the specified liquid to flow from the storage container 10 via the conveyance tube 11 to the receptacle16. Moreover, chemicals in the specified liquid in the conveyance tube 11 tend to deposit because there is no way to stir the liquid and therefore well mix the chemicals in the conveyance tube 11. Under this condition, even the liquid supplied to the receptacle is accurate in its total amount, it does not mean the chemicals in the liquid quantitatively meet specified amounts.

FIG. 3 illustrates another type of automatic precision liquid metering apparatus currently available in the market. In this second conventional precision liquid metering apparatus, the conveyance tubes 11 are omitted. The apparatus of FIG. 3 mainly includes a central shaft 20 that horizontally extends through a rotary table 21 to bring the latter to rotate clockwise or counterclockwise. A plurality of storage containers 22 are mounted along an outer periphery of the rotary table 21. Each storage container 22 is sealed with a cap 23. On each cap 23 there is provided a passage 24 via which liquid flows out from the storage container 22 and an amount of compressed air is supplied into the storage container 22, and a first solenoid valve 25 for controlling the open or close of the passage 24. Insulated connectors extended from positive and negative electrodes of the first solenoid valve 25 are adapted to contact with external positive and negative electrodes to make the first solenoid valve 25. The apparatus of FIG. 3 is also controlled through a microcomputer 26 and a control circuit 27 that sends instructions about the types and amounts of liquid to be supplied from the storage containers 22. When an instruction is sent, the rotary table 21 rotates to bring a storage container 22 having the specified liquid stored therein, that is referred to hereinafter as the selected storage container, to a topmost position on the rotary table 21, so that the cap 23 of the selected storage container 22 faces straight upward for the passage 24 thereof to pivotally connect to an air outlet 28 of an air supply tube 29. A second solenoid valve 34 is used to control the supply of air into the selected storage container 22 via the air supply tube 29. Thereafter, the selected storage container 22 is brought by the rotary table 21 to a lowest position on the rotary table 21, so that the cap 23 of the selected storage container 22 and the passage 24 thereof face straight downward. An electronic balance 30 carried on a traveling cart 31 is adapted to locate below the rotary table 21. The traveling cart 31 is provided with positive and negative electrodes 32 that are adapted to electrically connect to the positive and the negative electrode connectors of the first solenoid valve 25 on the cap 23 of the selected storage container 22, so that the passage 24 on the same cap 23 is opened by the first solenoid valve 25 thereof to allow liquid in the selected storage container 22 to flow into the receptacle 33 on the electronic balance 30. The electronic balance 30 is able to feed back a signal representing the measured weight of the liquid in the receptacle 33 to the control circuit 27 and the microcomputer 26. When the liquid in the receptacle 33 reaches a predetermined amount, the first solenoid valve 25 is shut off and the supply of liquid from the selected storage container 22 into the receptacle 33 is stopped. As in the first conventional precision liquid metering apparatus of FIG. 2, the apparatus of FIG. 3 must include several decades or even several hundreds of storage containers 22 and each of which requires a solenoid valve 25.

The following are some disadvantages of the second conventional precision liquid metering apparatus of FIG. 3 without the conveyance tubes 11:

1. The first solenoid valves 25 have limited usable life that is further shortened by frequent open and close of the first solenoid valves 25.

2. Each storage container 22 has only one passage 24 and it is necessary to supply compressed air into the storage container 22 for an internal pressure thereof to be larger than an external atmospheric pressure to let the liquid out of the storage container 22.

3. When the selected storage container 22 containing compressed air is moved to the lowest position on the rotary table 21, the internal air pressure of the selected storage container 22 tends to cause the liquid to flow out the storage container 22 into the receptacle 33 at unstable speed or even jet into the receptacle 33 and therefore adversely affects the accurate measurement of the liquid.

4. The internal pressure of the selected storage container 22 decreases while the liquid flows out of the storage container 22. When the internal pressure of the selected storage container 22 becomes smaller than the external atmospheric pressure, it would be necessary to charge compressed air into the selected storage container 22 again to empty the remaining liquid in the selected storage container 22.

SUMMARY OF THE INVENTION

It is therefore a primary object of the present invention to provide an automated precision liquid metering apparatus using injectors as metering devices to eliminate drawbacks existing in the conventional apparatus for precisely supplying and metering a specific liquid, particularly the apparatus using solenoid valves to control such precise supply of the specified liquid. To achieve this object, there is provided by the present invention an automated precision liquid metering apparatus including a plurality of storage containers uniformly spaced on a plane in multiple rows. Each storage container is sealed with a cap and has a loadstone disposed therein. A stirring means is located below the storage containers to cause the loadstones rotate and thereby evenly stir liquid in the storage containers to avoid deposition of chemicals in the storage containers. The cap of each storage container has at least one injector extended therethrough. A liquid sucking-releasing means mounted on a traveling means could be shifted to locate above a selected storage container under the control of a control means. When the liquid sucking-releasing means is in a descended position, it grabs the injector on the selected storage container, and when the same means grabbing the injector is shifted to an ascended position, it causes the injector to suck in an amount of liquid from the selected storage container while extracting the same injector from the selected storage container. The extracted injector is then moved along with the liquid sucking-releasing means by the traveling means to release all the previously sucked liquid into a receptacle positioned on an electronic balance at where the released liquid is precisely measured.

In the automated precision liquid metering apparatus of the present invention, either the metering or the solenoid valves are omitted to largely reduce the manufacturing cost of the apparatus without scarifying the accurate supplying and metering of the specified liquid.

Another object of the present invention is to provide an automated precision liquid metering apparatus that do not use conveyance tubes for transferring liquid from the storage containers to the receptacle. The problem of deposition of chemicals in the conveyance tubes can therefore be avoided. The omission of the conveyance tubes also reduces the manufacturing cost of the whole apparatus.

A further object of the present invention is to provide an automated precision liquid metering apparatus that allows quick and precise transfer of a specified liquid from a selected storage container into the receptacle within a largely shortened time period.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
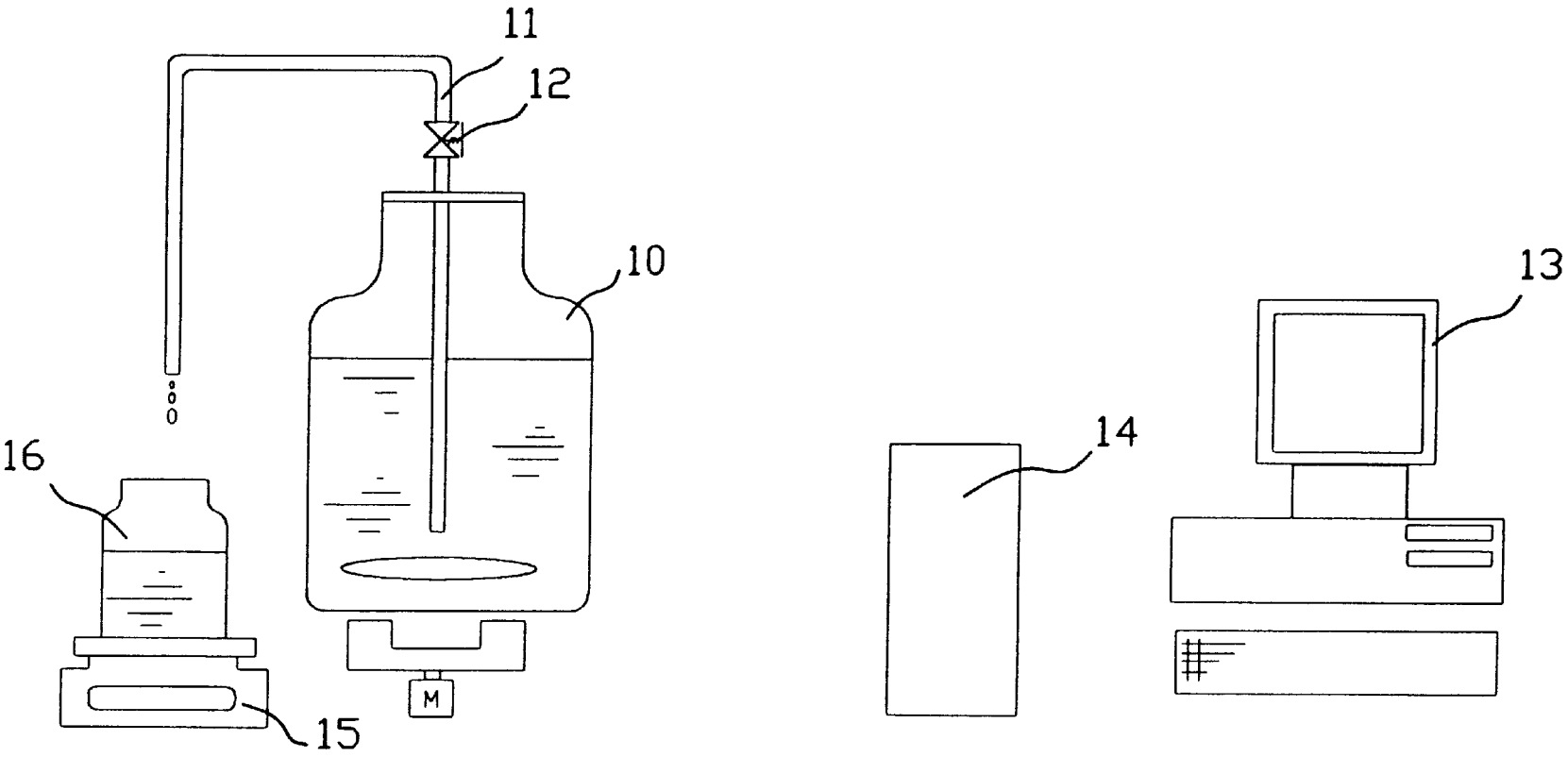
FIG.1 Prior Art
FIG. 1 is a schematic view of a conventional automatic precision liquid metering apparatus.
Figure 2:
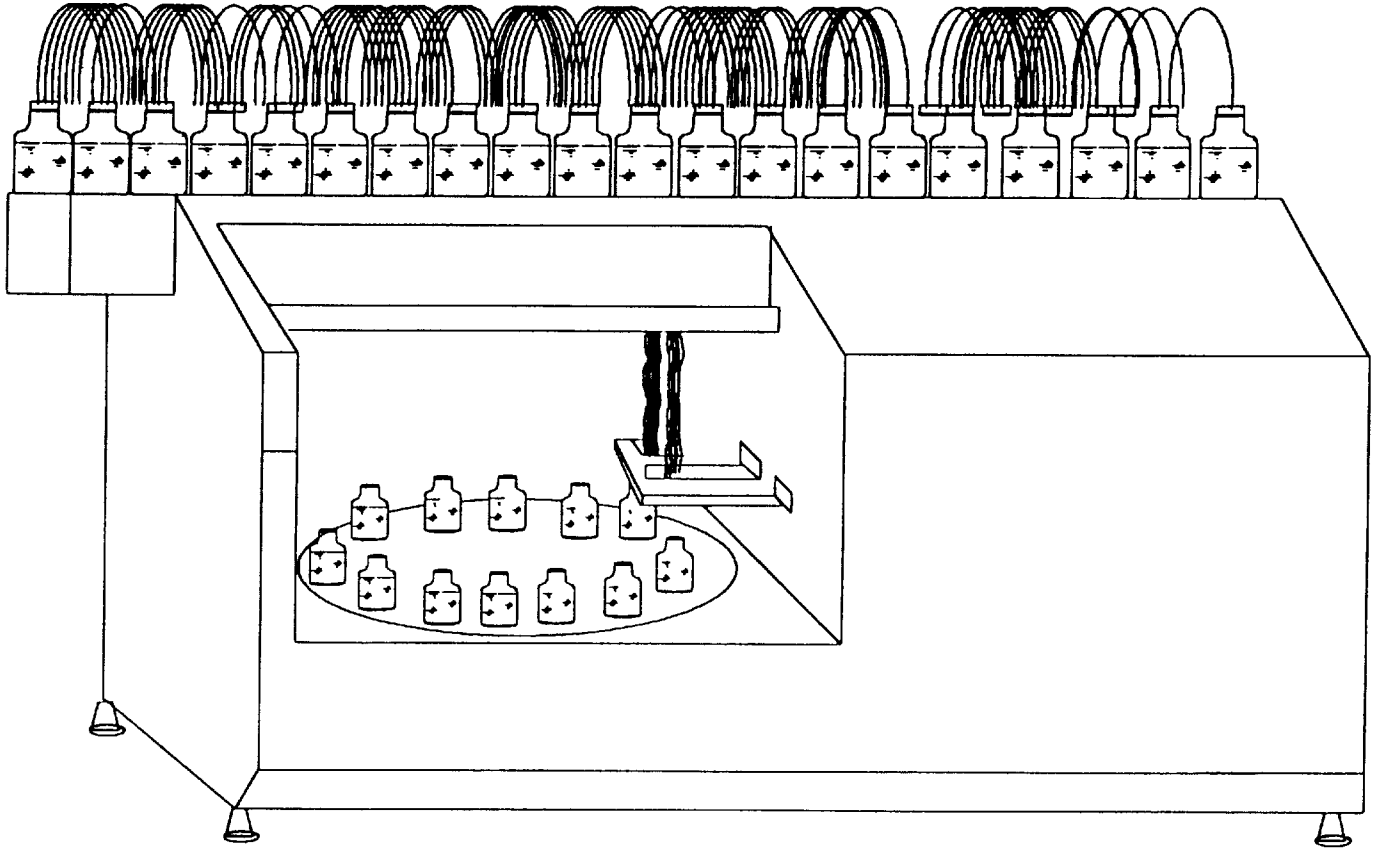
FIG.2 Prior Art
FIG. 2 is a schematic perspective view showing an application of the conventional automatic precision liquid metering apparatus of FIG. 1.
Figure 3:
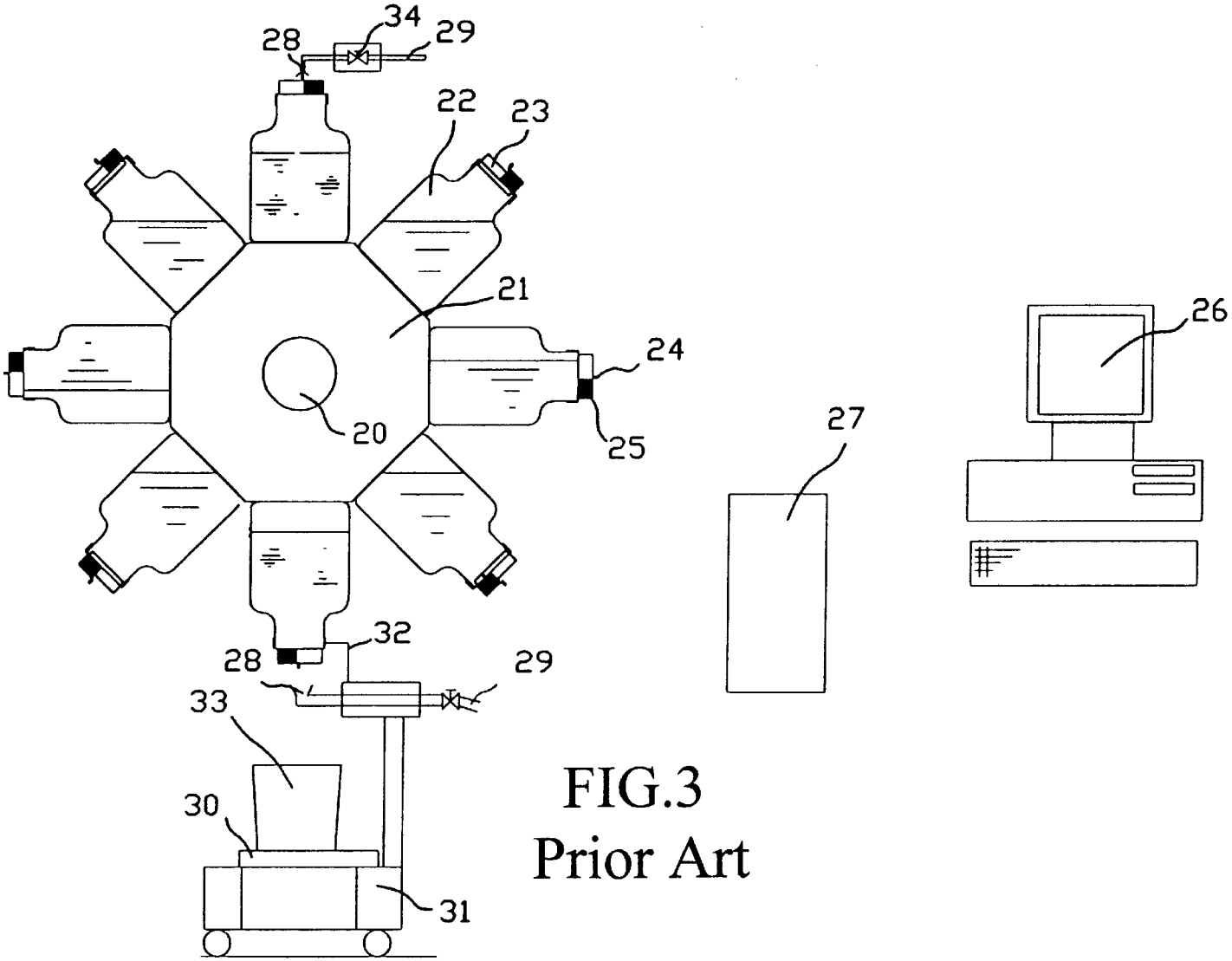
FIG.3 Prior Art
FIG. 3 is a schematic view of another conventional automatic precision liquid metering apparatus in which conveyance tubes are omitted.
Figure 4:
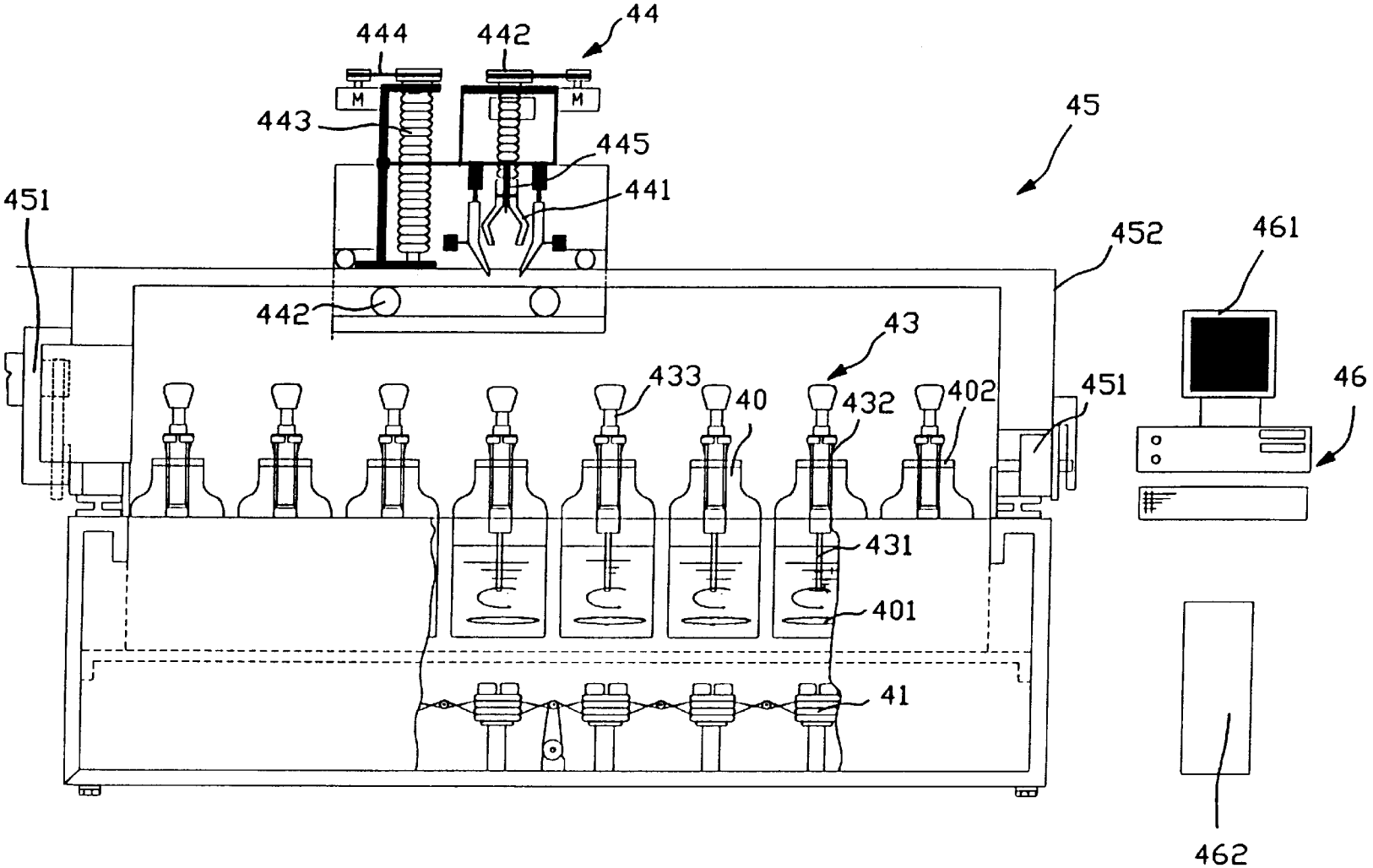
FIG. 4 is a plan view showing the arrangement of an automated precision liquid metering apparatus using injectors as metering devices according to the present invention.
Figure 5:
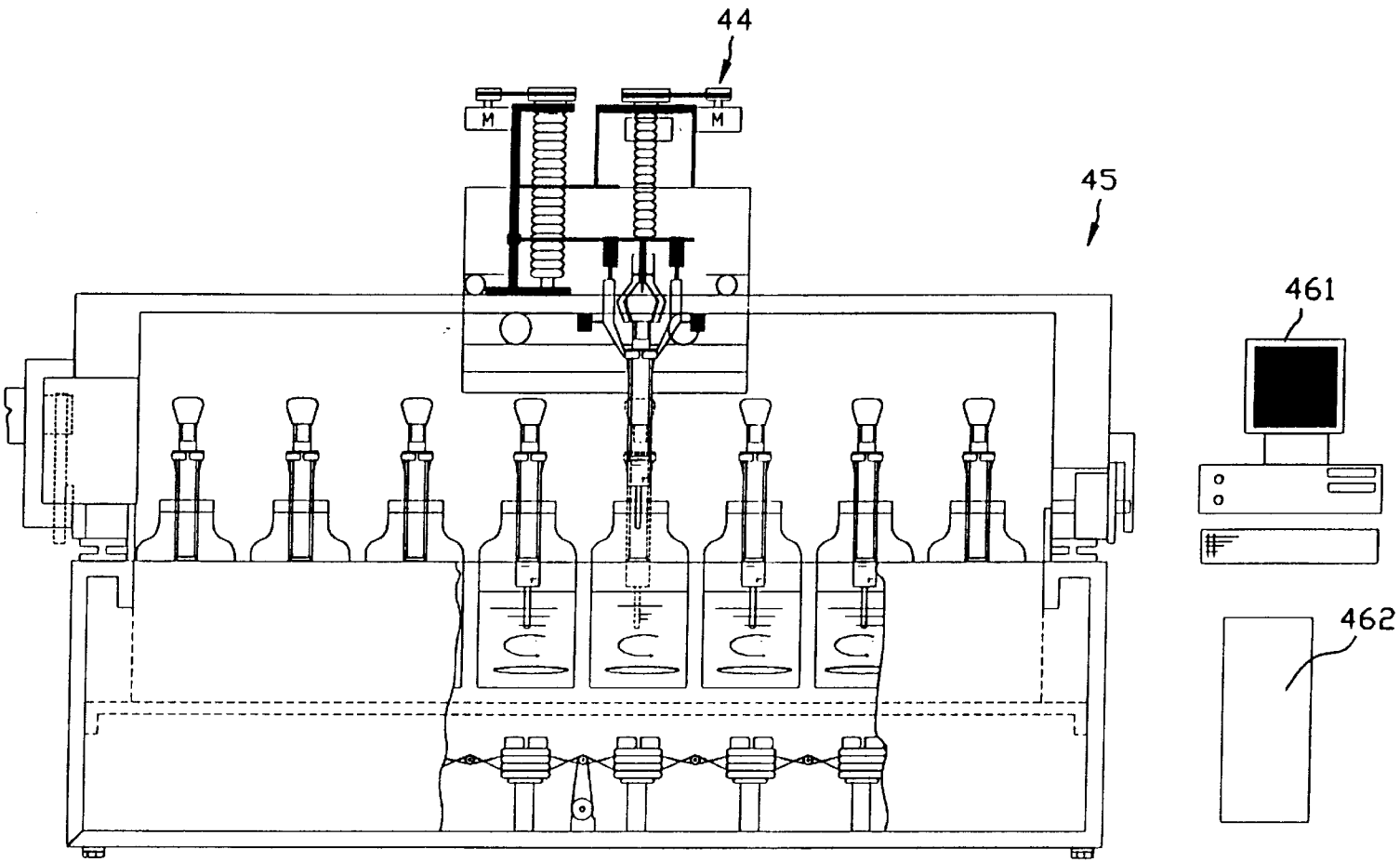
FIG. 5 is a plan view of the automated precision liquid metering apparatus of FIG. 4 showing the manner of descending and ascending cylinder-connected claws of the apparatus to grab and extract an injector from a selected storage container containing a specified liquid.
Figure 6:
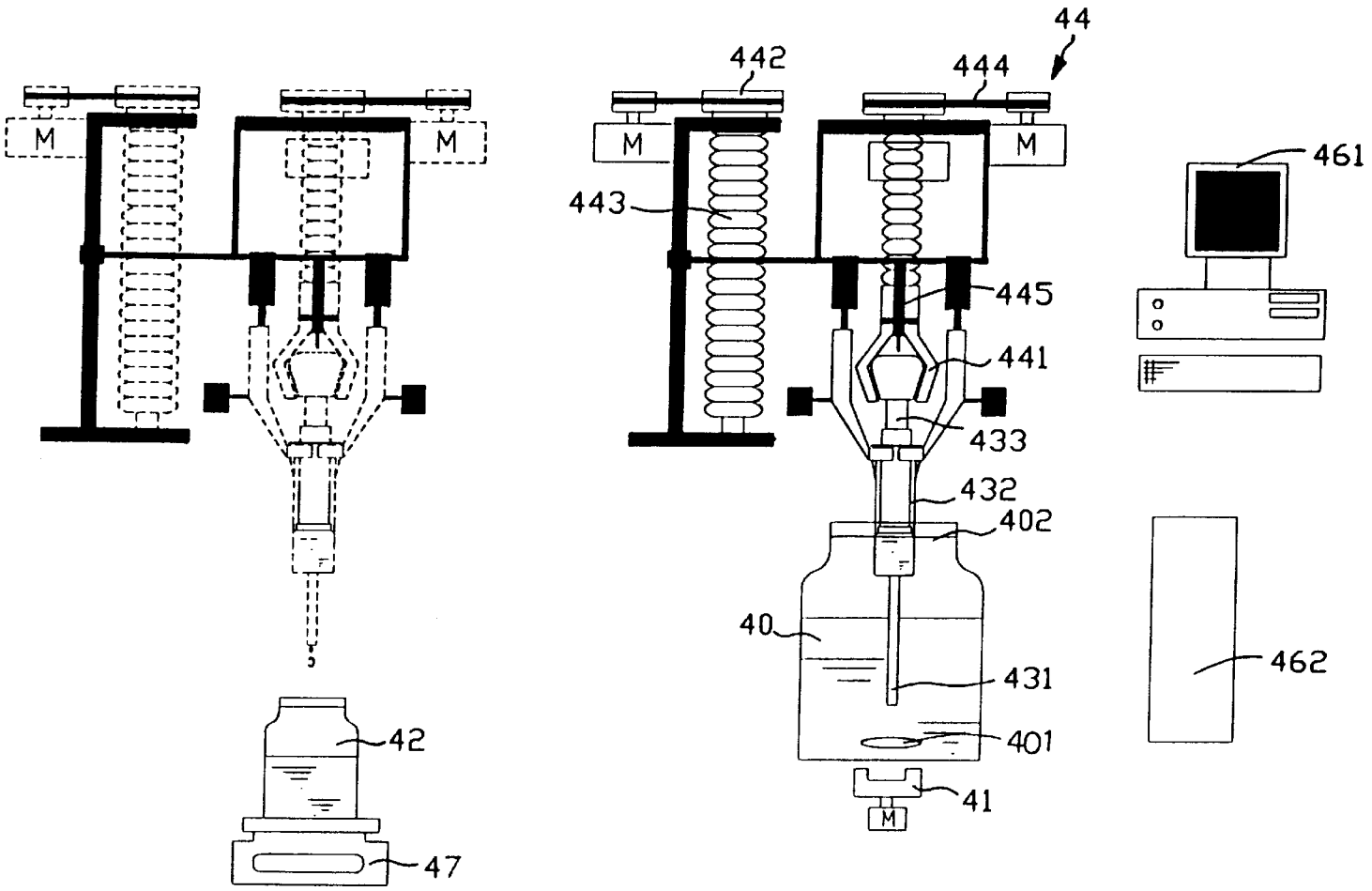
FIG. 6 is a plan view showing the manner of shifting the cylinder-connected claws of the automated precision liquid metering apparatus of FIG. 4 to transfer the specified liquid in the extracted injector to a receptacle.

Please refer to FIGS. 4 through 6, an automated precision liquid metering apparatus using injectors as metering devices according to the present invention mainly includes a plurality of storage containers 40, a stirring means 41, a receptacle 42, a plurality of injectors 43, a liquid sucking-releasing means 44, a traveling means 45, and a control means 46.

The liquid sucking-releasing means 44 includes multiple groups of cylinder-connected claws 441, multiple sets of servo or step motors 442, and a screw rod 443.

The traveling means 45 includes a plurality of sets of servo or step motors 451 and a shaft 452.

The control means 46 includes a microcomputer 461 and a control circuit 462. The storage containers 40 are uniformly spaced on a plane in multiple rows for each containing a specific liquid therein. Each of the storage containers 40 has a loadstone 401 disposed therein. The stirring means 41 is located below the storage containers 40 and adapted to cause the loadstones 401 to rotate and therefore evenly stir and mix chemicals in the liquid in each of the storage containers 40.

Each of the storage containers 40 is sealed with a cap 402. Each cap 402 has at least an injector 43 extended therethrough. The injector 43 each includes an outer barrel 432, and an inner plunger 433 slidably fitted in the barrel 432.

The barrel 432 has a narrowed front tube portion 431 deeply extended into the liquid in the storage container 40. The injector 43 is normally empty without holding any liquid therein. When a signal is sent by the microcomputer 461 of the control means 46 to supply a specified liquid from one of the storage containers 40, which will be hereinafter referred to as the selected storage container, an instruction is given by the control circuit 462 to the traveling means 45, so that the traveling means 45 moves the liquid sucking-releasing means 44 to a position immediately above the selected storage container 40 containing the specified liquid.

The liquid sucking-releasing means 44 is mounted on the shaft 452 of the traveling means 45. When the servo or step motors 451 of the traveling means 45 are started to move the shaft 452, the latter brings the liquid sucking-releasing means 44 mounted thereon to locate above the selected storage container 40. Thereafter, a first set of the servo or step motors 442 of the liquid sucking-releasing means 44 acts to ascend or descend the liquid sucking-releasing means 44. When the liquid sucking-releasing means 44 is in a descended position, it is able to grab at the injector 43 in the selected storage container 40. And, when the liquid sucking-releasing means 44 is in an ascended position, it is able to extract the injector 43 from the selected storage container 40 to separate the narrowed front tube portion 431 of the injector 43 from the cap 402 of the selected storage container 40.

More particularly, when the liquid sucking-releasing means 44 is in its descended position, a first group of the cylinder-connected claws 441 thereof are pushed forward to grab the barrel 432 of the injector 43, and a second group of the cylinder-connected claws 441 that are also fixedly connected to the screw rod 443 are caused to grab a top of the plunger 433 of the injector 43. When a second set of the servo or stop motors 442 that is connected to the screw rod 443 is started, a belt 444 of that motor 442 moves and brings the screw rod 443 to rotate. The rotating screw rod 443 in turn brings the group of cylinder-connected claws 441 fixed thereto and accordingly the plunger 433 of the injector 43 grabbed by this group of claws 441 to move upward. At this point, an amount of the specified liquid in the selected storage container 40 is sucked into the barrel 432 via the narrowed front tube portion 431. Thereafter, a first set of the servo or step motors 442 of the liquid sucking-releasing means 44 is started again to move the whole liquid sucking-releasing means 44 to the ascended position, so that the entire injector 43 is extracted from the cap 402 to separate from the selected storage container 40.

The liquid sucking-releasing means 44 in the ascended position and grabbing the injector 43 having an amount of the specified liquid sucked thereinto is then moved along with the shaft 452 of the traveling means 45 to the receptacle 42. When the narrowed front tube portion 431 of the injector 43 grabbed by the liquid sucking-releasing means 44 is in alignment with a central point of the receptacle 42, the liquid sucking-releasing means 44 is descended again to approach the narrowed front tube portion 431 to a top of the receptacle 42. The injector 43 is now ready to release the liquid previously sucked thereinto. At this point, the second set of servo or step motors 442 on the liquid sucking-releasing means 44 are started again to rotate the screw rod 443 and to push the plunger 433 of the injector 43 forward, so that the specified liquid in the barrel 432 of the injector 43 is pushed by the plunger 433 out of the barrel 432 to drop into the receptacle 42.

Since the barrel 432 of the injector 43 is a regular cylindrical member, there is a linear relationship between the amount of the specified liquid released from the barrel 432 and a distance between the plunger 433 and the narrowed front tube portion 431. That is, the amount of the liquid released from the barrel 432 could be determined by a distance by which the plunger 433 is fully pushed forward. Nevertheless, the released liquid amount can be finally determined only after it has been weighed with an electronic balance 47 on which the receptacle 42 is positioned.

It is to be noted that a tiny amount of the specified liquid would usually suspend at a lower end of the narrowed front tube portion 431 of the injector 43 at a final stage of releasing the sucked liquid from the barrel 432. This tiny amount of liquid is usually about 1/100 g in weight and would still affect the accurate amount of the specified liquid sucked from the selected storage container 40.

To solve this problem, the apparatus of the present invention includes a small cylinder 445 that is fixedly connected to the screw rod 443. When the small cylinder 445 is actuated, it would lightly knock the plunger 433, so that the final tiny amount of the specified liquid suspended at the lower end of the narrowed front tube portion 431 drops into the receptacle 42. And, a correct measurement of the specified liquid the same as the predetermined amount would usually be shown on the electronic balance 47.

What is claimed is:

1. An automated precision liquid metering apparatus using injectors as metering devices, comprising:

a plurality of storage containers uniformly spaced on a plane in multiple rows, each of which being sealed with a cap for containing an amount of a specific liquid and a loadstone therein;

a stirring means being located below said storage containers for causing said loadstones to rotate and thereby evenly mix chemicals in said specific liquid in said storage containers;

a receptacle being positioned on an electronic balance for receiving an amount of said specific liquid sucked from one storage container selected from said a plurality of storage containers;

a plurality of injectors being separately mounted on said storage containers, such that each said cap of said storage containers has at least one said injector extended therethrough; each of said injectors having a narrowed front tube portion extended into said specific liquid contained in each said storage container to allow an amount of said specific liquid to be sucked into said injector for releasing into said receptacle;

a traveling means being mounted above said storage containers;

a liquid sucking-releasing means being connected to said traveling means and adapted to be moved by said traveling means to a position above said selected storage container to cause said injector on said selected storage container to suck an amount of said specified liquid into said injector, to extract said injectors from said selected storage container, and to move said extracted injector to said receptacle and release said specific liquid in said injector into said receptacle; and a control means for controlling movement of said traveling means.

2. An automated precision liquid metering apparatus as claimed in claim 1, wherein said liquid sucking-releasing means includes multiple groups of cylinder-connected claws, multiple sets of servo or step motors, and a screw rod; a first group of said multiple groups of cylinder-connected claws being adapted to grab one of said injectors on said selected storage container separately at an outer barrel thereof and a second group at an inner plunger thereof; and a first set of said multiple sets of servo or step motors being adapted to ascend or descend said liquid sucking-releasing means relative to said storage containers, and a second set to rotate said screw rod and thereby ascend said second group of said cylinder-connected claws and accordingly pull upward said plunger grabbed thereat for said injector to suck an amount of said specified liquid in said selected storage container into said barrel of said injector, or descend said second group of said cylinder-connected claws and accordingly push forward said plunger to release said previously sucked specified liquid from said barrel into said receptacle.

3. An automated precision liquid metering apparatus as claimed in claim 1, wherein said traveling means includes multiple sets of servo or step motors and a shaft onto which said liquid sucking-releasing means is mounted; and said multiple sets of servo or step motors being adapted to move said shaft to any position specified by said control means.

4. An automated precision liquid metering apparatus as claimed in claim 1, wherein said control means includes a microcomputer and a control circuit; and said microcomputer sending a signal to said control circuit that in turn giving an instruction to said traveling means, so that said traveling means moves said liquid sucking-releasing means to a specified position over said a plurality of storage containers.

* * * * *